United States Patent [19]

Whitfill, Jr. et al.

[11] 4,005,168

[45] Jan. 25, 1977

[54] METHOD FOR MAKING A GAS BLOCKED LOGGING CABLE

[75] Inventors: William A. Whitfill, Jr.; Richard P. McNerney, both of Houston, Tex.

[73] Assignee: Schlumberger Technology Corporation, New York, N.Y.

[22] Filed: June 13, 1973

[21] Appl. No.: 369,665

Related U.S. Application Data

[62] Division of Ser. No. 302,159, Oct. 30, 1972, Pat. No. 3,800,066.

[52] U.S. Cl. ..... 264/103; 156/56; 156/275; 264/174

[51] Int. Cl.[2] ..... H01B 7/24; H01B 7/02

[58] Field of Search ..... 264/174, 103; 174/116; 156/275, 56

[56] References Cited

UNITED STATES PATENTS

| | | | |
|---|---|---|---|
| 2,544,233 | 3/1951 | Kennedy | 174/116 |
| 2,810,424 | 10/1957 | Swartswelter et al. | 264/174 |
| 3,106,815 | 10/1963 | Nance et al. | 57/13 |
| 3,236,939 | 2/1966 | Blewis et al. | 174/116 |
| 3,433,687 | 3/1969 | Price | 156/275 |
| 3,541,682 | 11/1970 | Hildebrandt | 156/275 |

FOREIGN PATENTS OR APPLICATIONS

| | | | |
|---|---|---|---|
| 403,371 | 12/1933 | United Kingdom | 174/116 |

*Primary Examiner*—Jeffery R. Thurlow
*Attorney, Agent, or Firm*—David L. Moseley; William R. Sherman; Stewart F. Moore

[57] ABSTRACT

Method and apparatus for forming a well logging cable that is gas-blocked by virtue of having solid outer conductors cabled around a stranded, filled center conductor and interred in a monolithic matrix material. Substantially all void spaces are thereby eliminated to prevent collection of gas anywhere within the cable at high temperatures and pressures.

3 Claims, 5 Drawing Figures

METHOD FOR MAKING A GAS BLOCKED LOGGING CABLE

This application is a division of application Ser. No. 302,159, filed Oct. 30, 1972, now U.S. Pat. No. 3,800,066, issued Mar. 26, 1974.

This invention relates to methods and apparatus for forming electrical cable cores, particularly well logging cable cores that are gas blocked for use in logging well bores containing gas-cut muds.

A standard multi-conductor well logging cable has a core comprised of six outer conductors cabled around a single center conductor and embedded in a neoprene matrix. The outer conductors are usually formed by copper wire strands twisted around a single center strand, whereas typically the inner conductor has strands twisted around a plastic monofilament. Of course each conductor is covered with a layer of suitable insulation material. Although the neoprene matrix fills substantially all the voids between conductors within the cable core, particularly where the cable is manufactured according to the teachings of U.S. Pat. No. 3,106,815, assigned to the assignee of this invention, voids still may exist within the conductors themselves between and about the strands.

Although the use of the foregoing cable construction is highly satisfactory for many well logging operations, its use in wells containing substantial amounts of low molecular weight hydrocarbons such as methane gas involves a substantial risk of failure in the cable and/or the cable terminations when the cable is rewound after a logging job. Such failure is due to the fact in the depths of the borehole and at temperatures above 150°, which is quite common, the gas can permeate the matrix of the cable and the insulation materials of the conductors due to a phenomenon that may be called activated diffusion, and causes pressure buildup and gas entrapment in the conductor voids. As the cable is removed from the well and wound back upon the drum at the surface, release of the entrapped gas is only accomplished through bleed out at the terminated ends of the conductors, or outright rupture of the insulation materials themselves. Either case can, and often does, result in highly undesirable cable failure due to electrical shorting.

It is the principal object of this invention to provide a new and improved well logging cable having the conductors constructed in such a manner as to contain substantially no voids to thereby obviate the problem of cable failure after logging wells containing gas-cut mud.

This and other objects are attained in accordance with the concepts of the present invention by providing a multi-conductor cable construction wherein the center conductor has strands twisted around a plastic monofilament. To eliminate internal interstices between strands, the conductor is heated under tension to cause the strands to embed in the monofilament. Either subsequently or simultaneously, the outer interstices between strands are filled to eliminate voids by compression extrusion of a thermoplastic resin, and then a final coating of insulation material is applied over the filled conductor. The outer conductors are solid wires that are cabled around the filled center conductor and embedded within a neoprene matrix. The combination of the solid outer conductors and a completely filled inner conductor provides a resultant cable construction that contains substantially no voids whatever within which gas can collect, and not containing the voids necessary for collection of permeated gas is not subject to rupture and failure upon withdrawal from the well.

The present invention has other objects and advantages which will become more clearly apparent in connection with the following detailed description of a preferred embodiment, taken in conjunction with the appended drawings in which.

Figure 1:
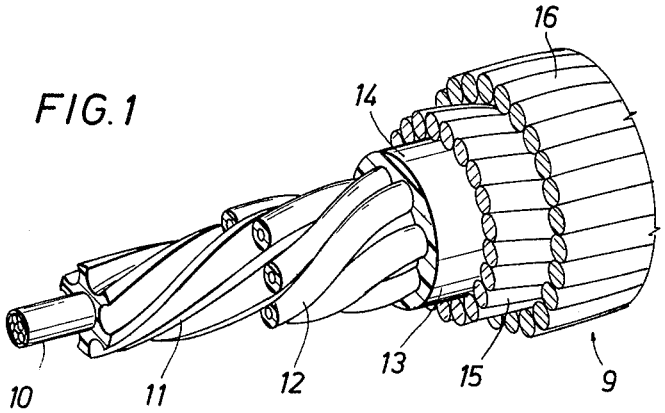
FIG. 1 is a perspective view of a well logging cable with successive components broken away to illustrate details of the cable construction.

A cable 9 formed in accordance with the present invention as illustrated in FIG. 1 has a central, axial conductor 10 that includes wires stranded around a plastic monofilament and encased in an insulation material to be more fully described herebelow. The conductor 10 is centrally embedded in a core matrix member 11. Spirally wound about the member 11 are outer, insulated, solid copper wire conductors 12, the spiraled conductors 12 being completely encased by additional embedding material 13 that joins with the matrix material 11 to provide a monolithic sheathing 14 having a generally cylindrical outer surface. Both the core matrix member 11 and the embedding material 13 preferably are formed of an extrudable, semi-conductive, oil and gas resistant elastomer that cures to a hard flexible, relatively incompressible form and maintains its physical properties at borehole temperature and pressures. As an example, the acrylonitrile butadiene rubber known commercially by the trade name "Hycar" is well adapted for this purpose. It should be noted that the spiraled conductors 12 are firmly and uniformly supported and separated from each other and from the axial conductor 10 by the sheathing material. Oppositely spiraled armor wires 15 and 16 are received over the sheathing 14 to provide mechanical protection and strength to adapt the composite cable for use in well logging operations.

At this point it should be noted that in a typical prior art well logging cable, as previously mentioned, all the conductors are stranded. Thus the provision of solid copper wires for the outer conductors serves to eliminate void spaces for apparent reasons. However, it has been found that it is not appropriate to use a solid conductor in the center of the cable because of the elongation requirements of a well logging cable. That is to say, a well logging cable which may be for example 20–30,000 feet long, when suspended in a borehole undergoes considerable elongation that would exceed the elastic limit of a solid center conductor and result in highly undesirable "Z" kinks therein. Accordingly, the center conductor 10 is formed by stranded wires similar to the prior art construction, however the conductor is completely filled in accordance with the present invention.

Figure 2:
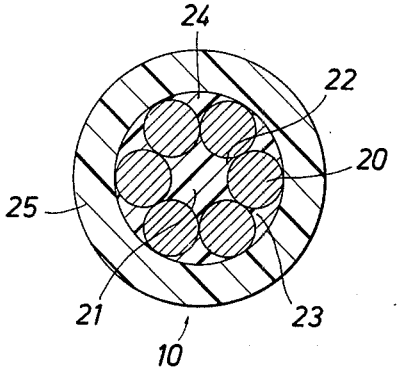
FIG. 2 is an enlarged cross-sectional view of the center conductor of the cable to illustrate the configuration of the various components after being formed in accordance with the present invention.

The cross-section of the axially disposed conductor 10 is shown in enlarged detail in FIG. 2, and is constructed by a plurality, for example, six copper wire strands 20 around a center thermoplastic monofilament 21. The monofilament 21 is a fluorocarbon polymer such as FEP "Teflon", a registered trade name of DuPont. The inner interstices 22 of the conductor 10 are filled in a particular manner by the simultaneous application of heat and tension causing the wire strands 20 to embed in the monofilament 21 as will be explained more fully herebelow. The outer interstices 23 are filled by compression extrusion of a thermoplastic resin material 24 that does not degrade at temperatures at least up to about 450° F, and which has acceptable flow properties at normal processable temperatures, for example about 625° F, so as to be capable of filling the external interstices of the strands. One suitable material is a copolymer sold under the trade name TEFZEL by DuPont. Finally an outer coating of insulation material 25 is applied by extrusion and is also a fluorocarbon polymer, preferably FEP "Teflon". The conductor wire strands 20 as shown are thus embedded in a monolithic body having substantially no void spaces or pockets into which gas that would permeate the insulation materials under high temperature and pressure can collect.

Figure 3A:
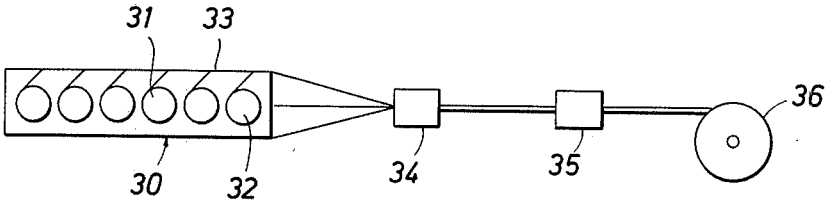
FIGS. 3A–3C are somewhat schematic view of apparatus for forming the cable illustrated in FIGS. 1 and 2.
Figure 3B:
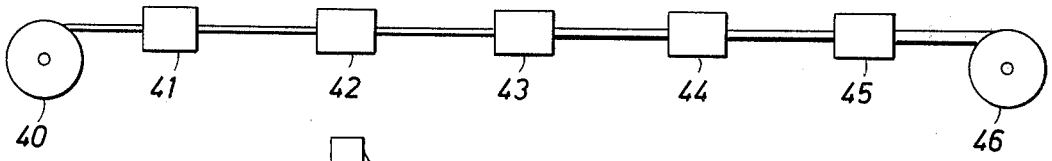
Figure 3C:
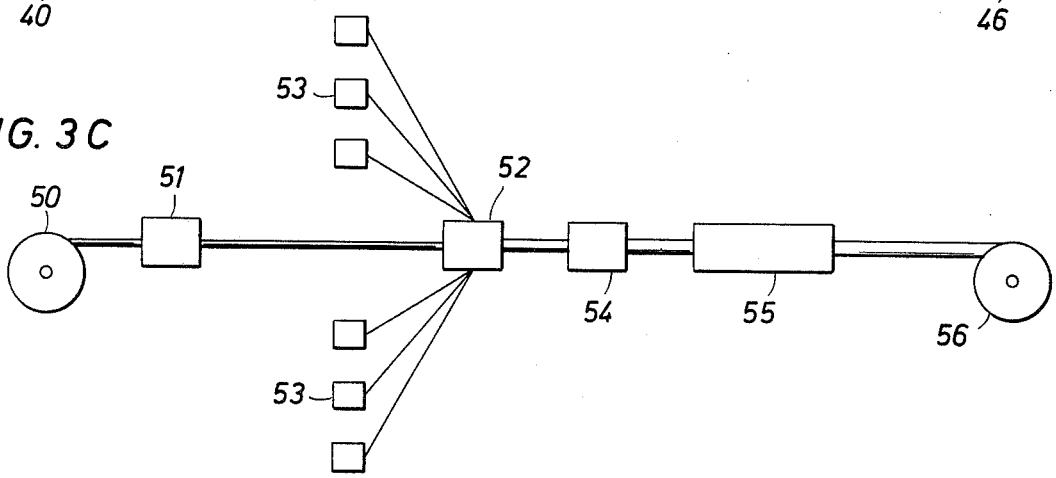

Apparatus for forming the cable 9 is shown schematically in FIGS. 3A–C. In FIG. 3A, a typical high speed tubular strander 30 contains supply spools 31 for the copper wire strands 20 and a supply spool 32 for the plastic monofilament 21. The strands 20 feed to the outside of the tube 33 as it rotates, and at the forward end of the tube through a closing die 34 where they are formed around the monofilament 21. From here the conductor passes to a capstan assembly 35 and then to a storage reel 36. At this point, the monofilament 21 has a tubular form with the wires 20 stranded therearound in typical configuration. In order to imbed the strands 20 at least partially in the outer surface of the monofilament 21, the stranded conductor 10 is paid off of a reel 40 as shown in FIG. 3B and is passed through a constant tension device 41, that may be, for example a combination of a capstan and pulleys that incorporate either a mechanical brake or an electrical device such as a typical hysteresis brake. In any event the result is to place the conductor 10 under a substantially constant tension of predetermined magnitude. Under tension, the conductor is passed through a heater 42 that applies sufficient heat to soften the monofilament 21 so that radial inward forces on the strands 20 due to tension cause them to imbed in the outer periphery of the monofilament and to attain the cross-section configuration shown in FIG. 2. Next the conductor 10 passes through an extruder 43 with a compression extrusion set-up where the thermoplastic filler material 24 is applied to completely fill the external interstices as shown in FIG. 2, whereupon the filled conductor passes through a second extruder 44 having a tubing extrusion set-up. Here the insulation material 25 is applied around the strands 20 and the filler material 24. Then the conductor 10 feeds through a capstan assembly 45 that preferably is driven by a constant speed motor and together with the constant tension device 41 dictates a carefully controlled tension for the conductor as it passes through the elements 42, 43 and 44. Finally, of course, the conductor is wound up on a storage reel 46.

Referring now to FIG. 3C, the complete core of the cable 9 is formed by supplying the filled axial conductor 10 from a spool 50 where it is subjected to an extruding device 51 that applies the uncured, semi-conductive core material thereto to form the matrix member 11 with a generally cylindrical form. The member 11 is then fed through a closing die represented at 52. Into the die are also fed the insulated solid copper conductors 12 that are supplied from spools 53 mounted in a well known manner upon a rotatable frame. The frame and closing die 52 rotate about a common axis and the conductors 12 are embedded in the core member 11 in passing through the closing die. The core member 11 is then fed through a second extruding device 54 where the uncured outer sheathing material 13 is applied under pressure to cause the matrix material to extrude about the outer parts of the spiraled conductors 12 and to merge with the inner core member 11. Next the assembly is subjected to curing action in an oven 55 which forms the sheathing into a monolithic body that firmly embeds the conductors therein again, with substantially no void spaces. Finally the inner and outer armor wires 15 and 16 are applied by known means (not shown) and the finished cable is stored upon a reel or spool 56.

As a working example to further illustrate the construction of the inner or axial conductor 10, the strands 20 may be six 27 AWG (0.0142 inch O.D.) bright copper wire stranded around the thermoplastic monofilament 21 having a diameter of 0.016 inches. This conductor is coated with a 0.005 inch wall thickness of the filler material 24 using minimum extruder screw speed and adjusting the wire speed to maintain the desired finished diameter of 0.053 inch. The heater current is set at 25 amps and the wire tension at 15 pounds. These parameters dictate a line speed of about 100 fpm using a 2 inch, 20:1, length to diameter ratio, plasticating extruder with a temperature profile and extruder materials as recommended by the supplier of the thermoplastic resin 24. The assembly is coated with 0.010 inch wall thickness of the insulation material 25. The complete cable 9 having the filled axial conductor 10 and the solid outer conductors 12 disposed in a monolithic body of matrix material 14 provides a well logging cable containing substantially no voids within which gas can collect, so that the cable is not subject to rupture and failure upon withdrawal from the well.

Since certain changes or modifications may be made by those skilled in the art without departing from the inventive concepts involved, it is the aim of the appended claims to cover all such changes and modifications falling within the true spirit and scope of the present invention.

We claim:

1. A process for making a gas blocked electrical cable, comprising the steps of: twisting a plurality of conductive wire strands around a thermoplastic monofilament; embedding said strands at least partially in the outer surface of said monofilament to eliminate internal void spaces between strands; said embedding step being performed by heating said conductor while applying tension thereto to soften said monofilament and force said strands at least partially into the external surfaces thereof; applying a thermoplastic filler material around said strands to fill the external void spaces between said strands and thereby form a completely filled conductor; extruding a layer of insulation material over said filled conductor; cabling a plurality of solid insulated conductors around said filled conductor; and disposing all of said conductors within a void-free matrix forming material.

2. The process of claim 1 wherein said applying step comprises compression extrusion of said filler material to cause said material to flow inwardly into said external void spaces.

3. The process of claim 1 including the further steps of applying inner and outer layers of armor wires around said conductors.

* * * * *